US011518169B2

(12) United States Patent
Ha et al.

(10) Patent No.: US 11,518,169 B2
(45) Date of Patent: Dec. 6, 2022

(54) APPARATUS FOR DISTRIBUTING LOAD AND SYSTEM FOR TREATING SUBSTRATE WITH THE APPARATUS

(71) Applicant: SEMES CO., LTD., Chungcheongnam-do (KR)

(72) Inventors: In Seok Ha, Chungcheongnam-do (KR); Jin Hyuck Yang, Daegu (KR); Jae Young Jang, Chungcheongnam-do (KR)

(73) Assignee: Semes Co., Ltd., Chungcheongnam-do (KR)

( * ) Notice: Subject to any disclaimer, the term of this patent is extended or adjusted under 35 U.S.C. 154(b) by 40 days.

(21) Appl. No.: 17/237,175

(22) Filed: Apr. 22, 2021

(65) Prior Publication Data

US 2021/0331466 A1 Oct. 28, 2021

(30) Foreign Application Priority Data

Apr. 23, 2020 (KR) ..... 10-2020-0049568

(51) Int. Cl.
*B41J 2/145* (2006.01)

(52) U.S. Cl.
CPC ..... *B41J 2/145* (2013.01)

(58) Field of Classification Search
CPC ..... B41J 2/145
See application file for complete search history.

(56) References Cited

U.S. PATENT DOCUMENTS 6,660,332 B2 * 12/2003 Kawase ..... G02B 5/201 427/466
7,742,144 B2 6/2010 Song et al.
(Continued)

FOREIGN PATENT DOCUMENTS

JP 2005246113 A 9/2005
JP 2007183555 A 7/2007
JP 2009248559 A 10/2009
(Continued)

OTHER PUBLICATIONS

Japanese Notice of Reasons for Refusal for Japanese Application No. 2021-072589, dated May 31, 2022 with translation, 6 pages.
(Continued)

*Primary Examiner* — Jason S Uhlenhake
(74) *Attorney, Agent, or Firm* — RatnerPrestia

(57) ABSTRACT

Provided are a load distribution apparatus capable of efficiently distributing loads for a plurality of inkjet head modules and a substrate treatment system including the same. The load distribution apparatus includes a second support formed to be elongated in one direction and having both side portions higher than a central portion and in which a head module for discharging droplets onto a substrate is installed in the central portion, a first support supporting the second support on at least one side and supporting the second support below the second support, a first support unit supporting the second support on at least one side and supporting the second support above the second support, and a plate installed above the first support unit and connected to the first support unit, wherein a load of the head module is distributed by the first support and the first support unit.

20 Claims, 19 Drawing Sheets

(56) References Cited

U.S. PATENT DOCUMENTS

| | | | | |
|---|---|---|---|---|
| 2005/0185006 | A1* | 8/2005 | Miyasaka | B41J 2/145 347/9 |
| 2016/0288414 | A1* | 10/2016 | Ozbolat | A61F 2/2875 |

FOREIGN PATENT DOCUMENTS

| | | | |
|---|---|---|---|
| JP | 2013000656 | A | 1/2013 |
| JP | 2013063603 | A | 4/2013 |
| KR | 1020120065897 | A | 6/2012 |
| KR | 1020150047203 | A | 5/2015 |

OTHER PUBLICATIONS

Korean Request for the Submission of an Opinion for Korean Application No. 10-2020-0049568, dated Aug. 29, 2022 with translation, 11 pages.

* cited by examiner

[FIG. 1]
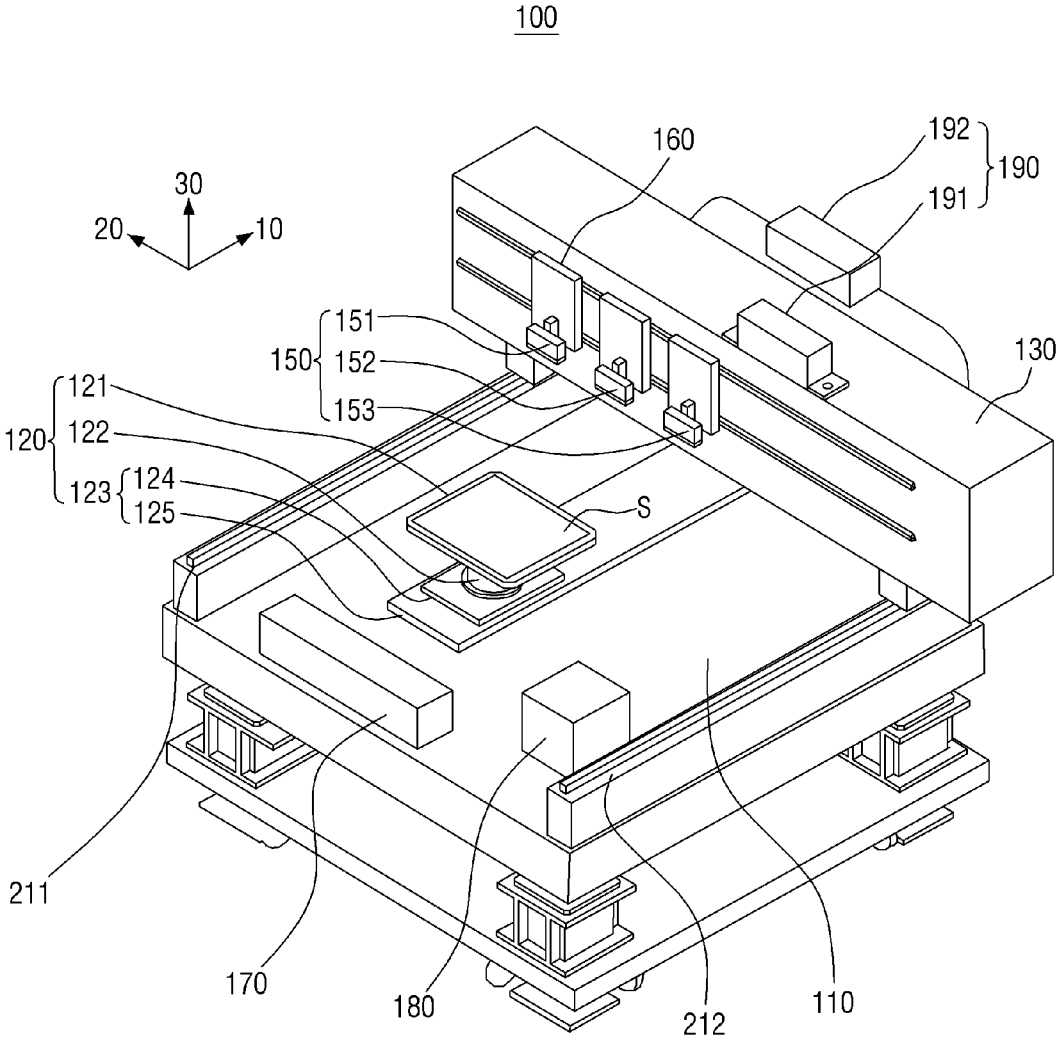

[FIG. 2]
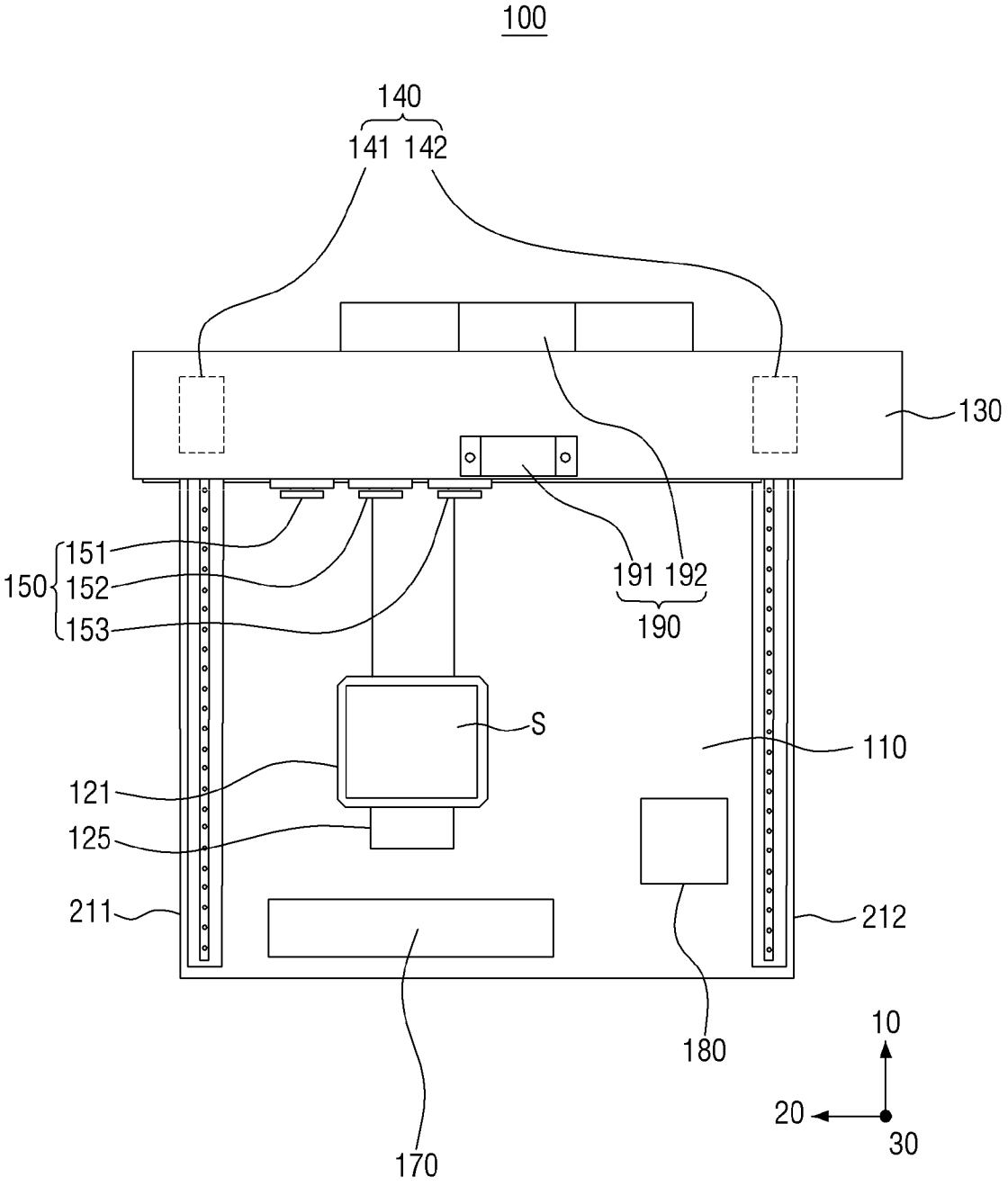

[FIG. 3]
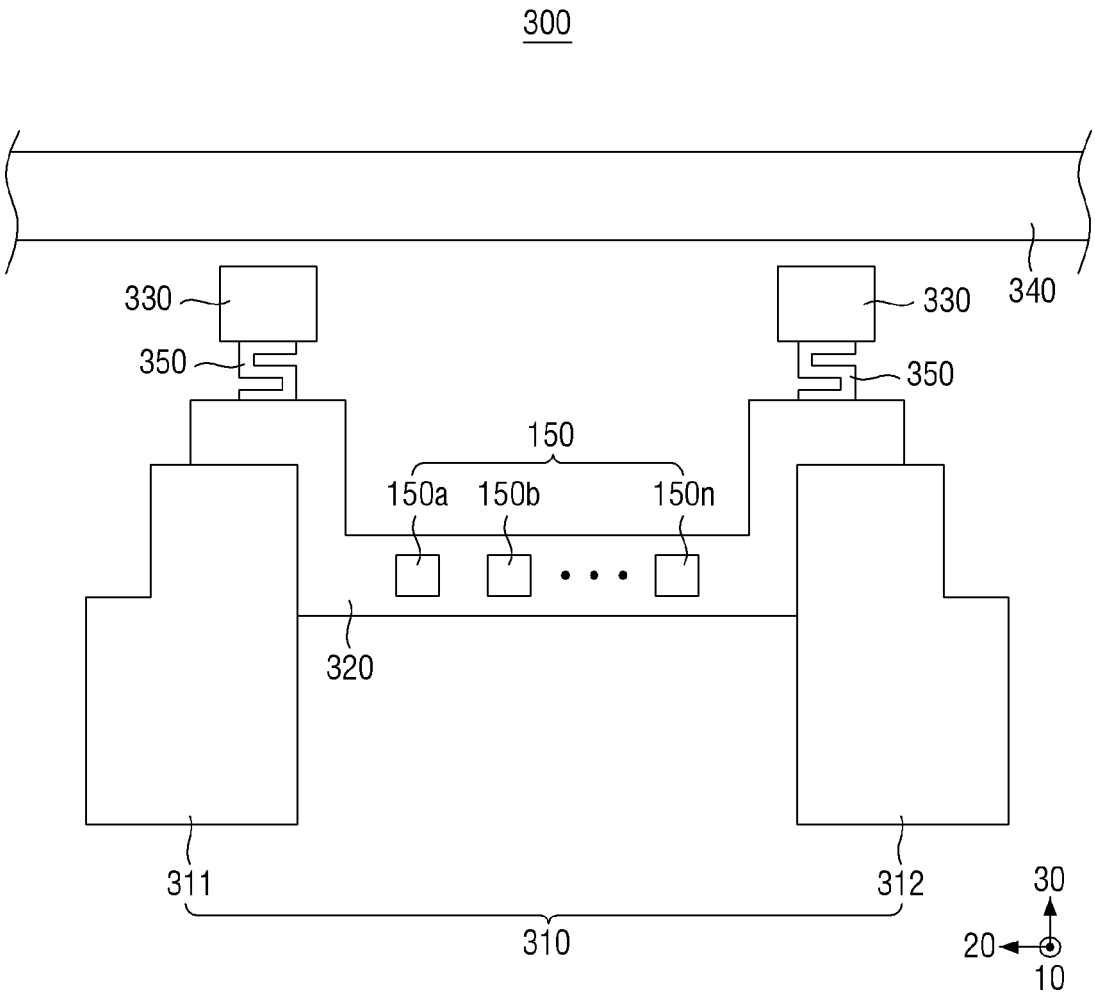

[FIG. 4]
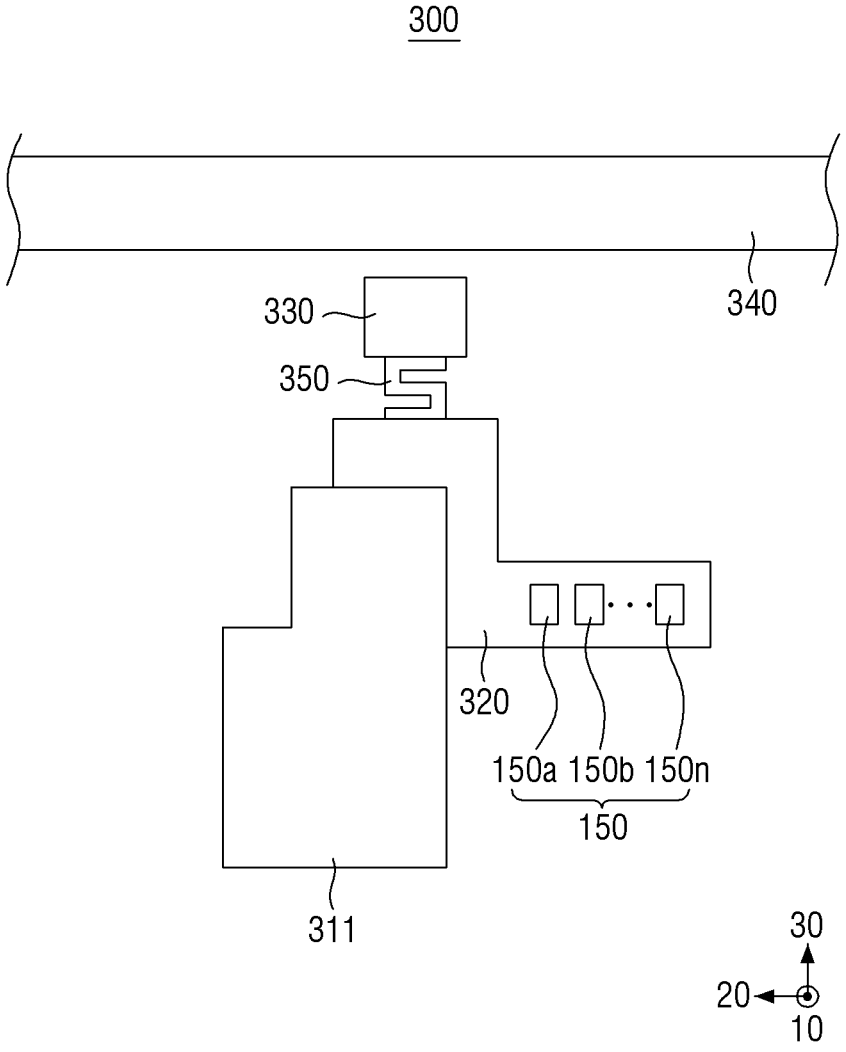

[FIG. 5]
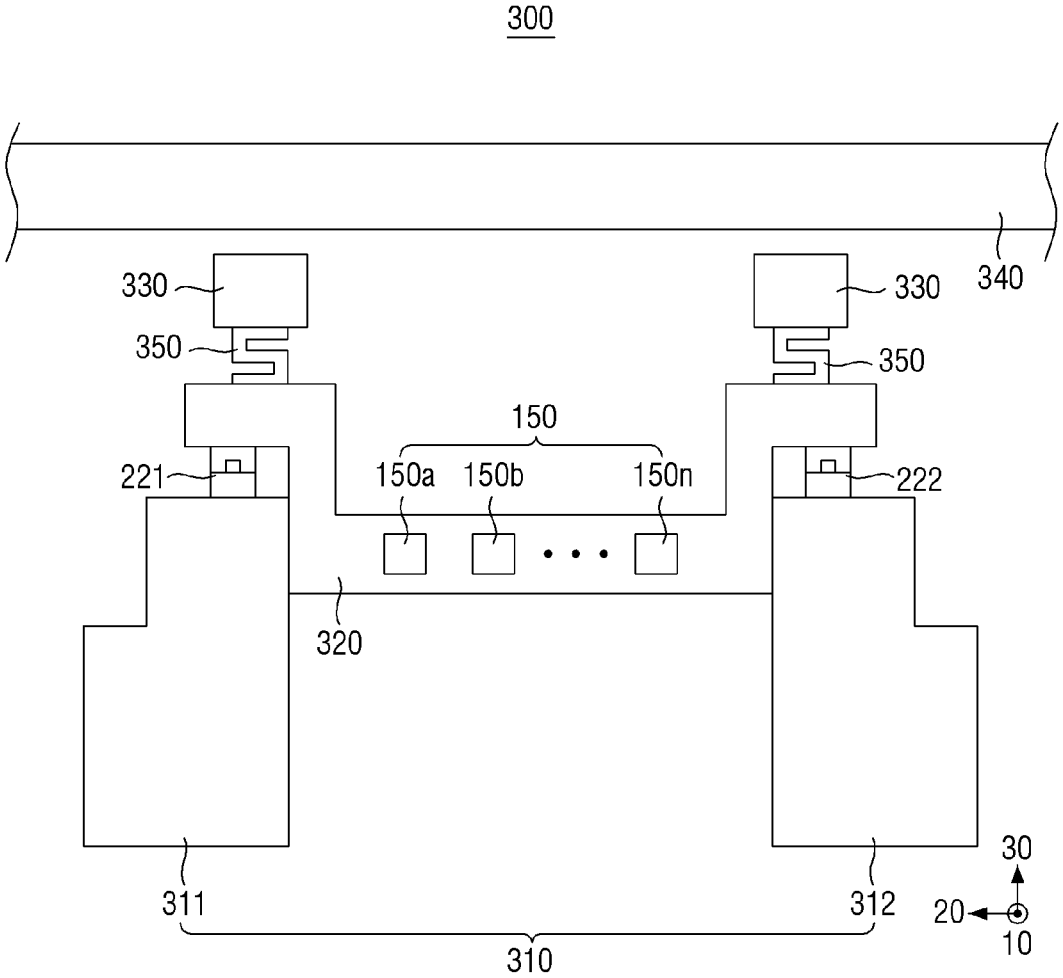

[FIG. 6]
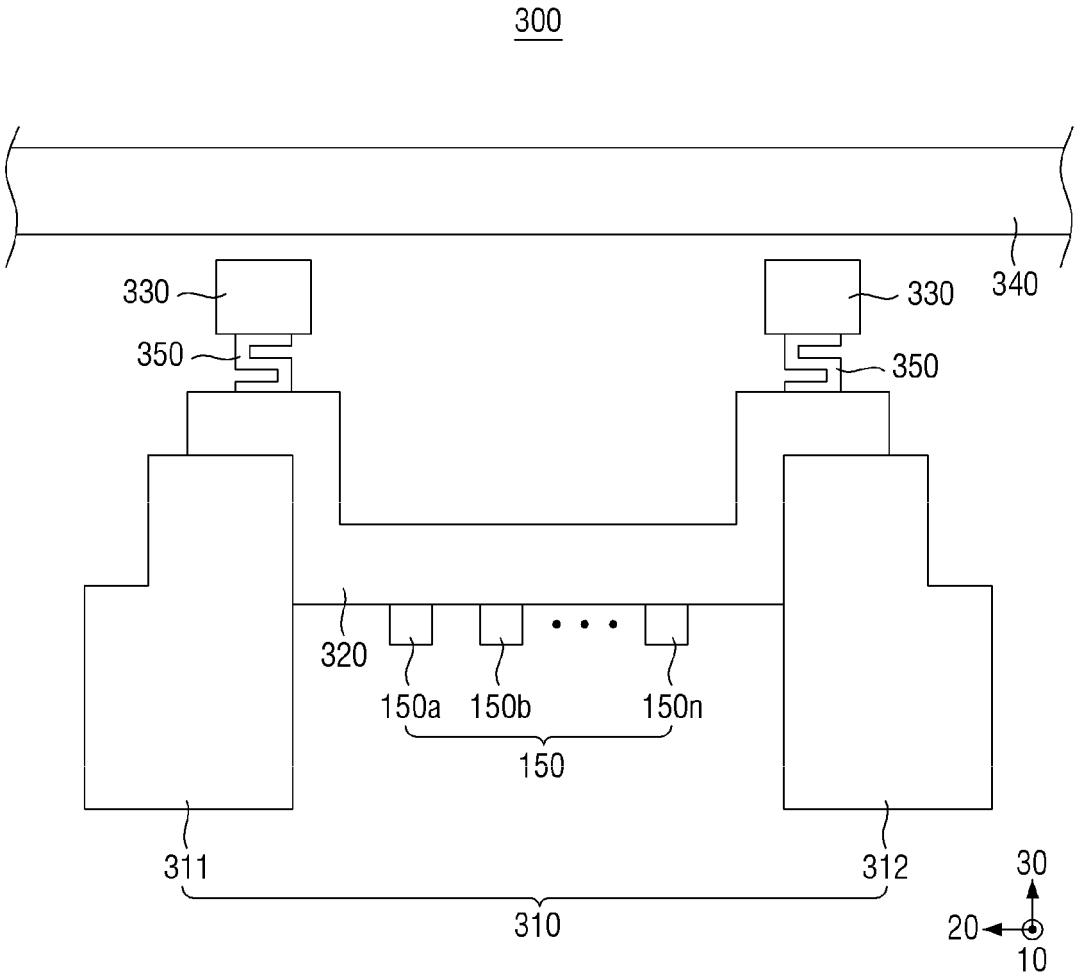

[FIG. 7]
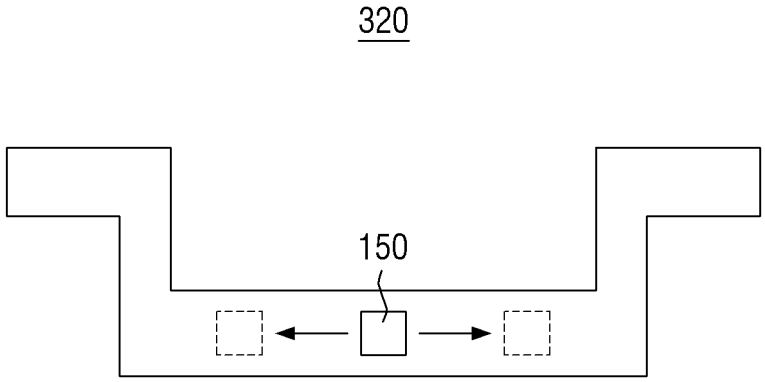

[FIG. 8]
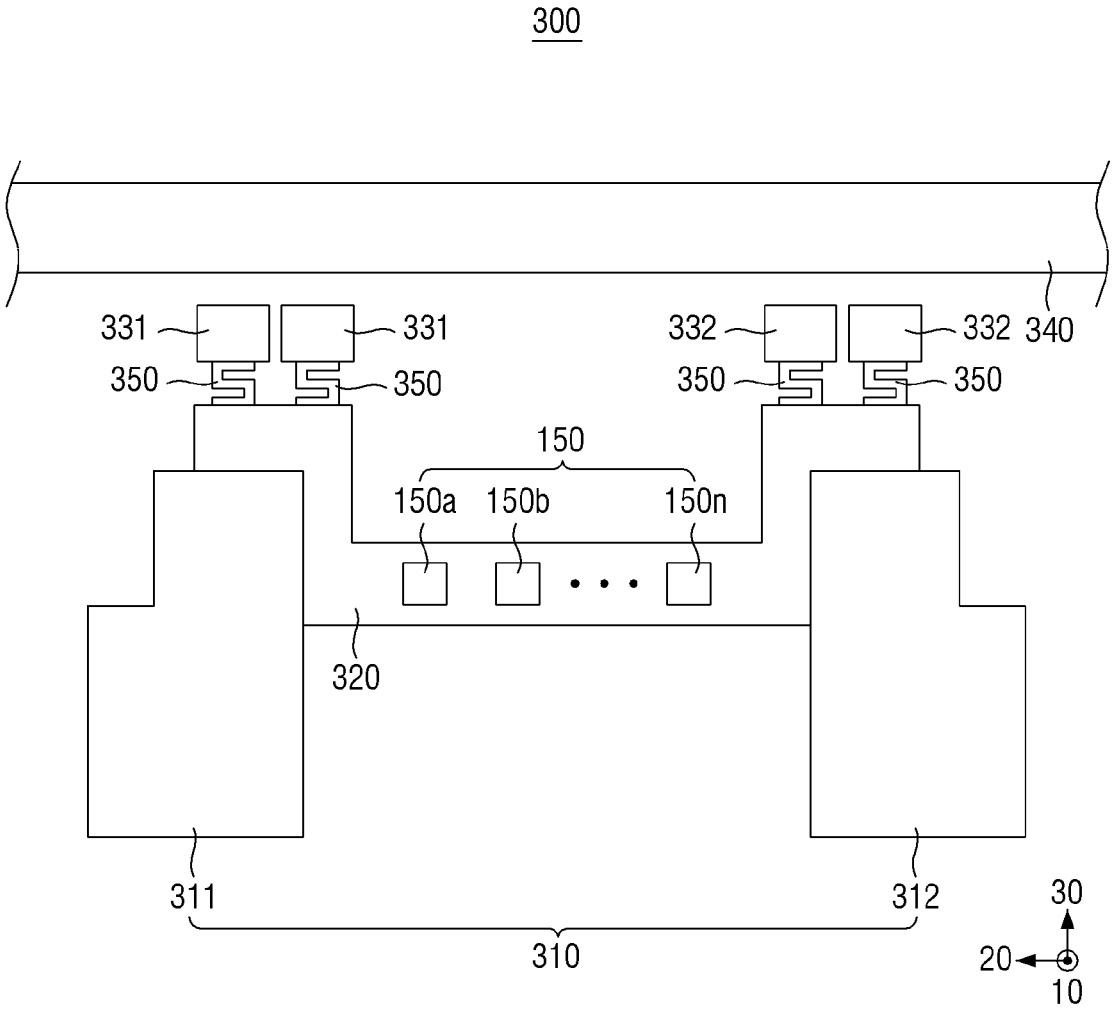

[FIG. 9]
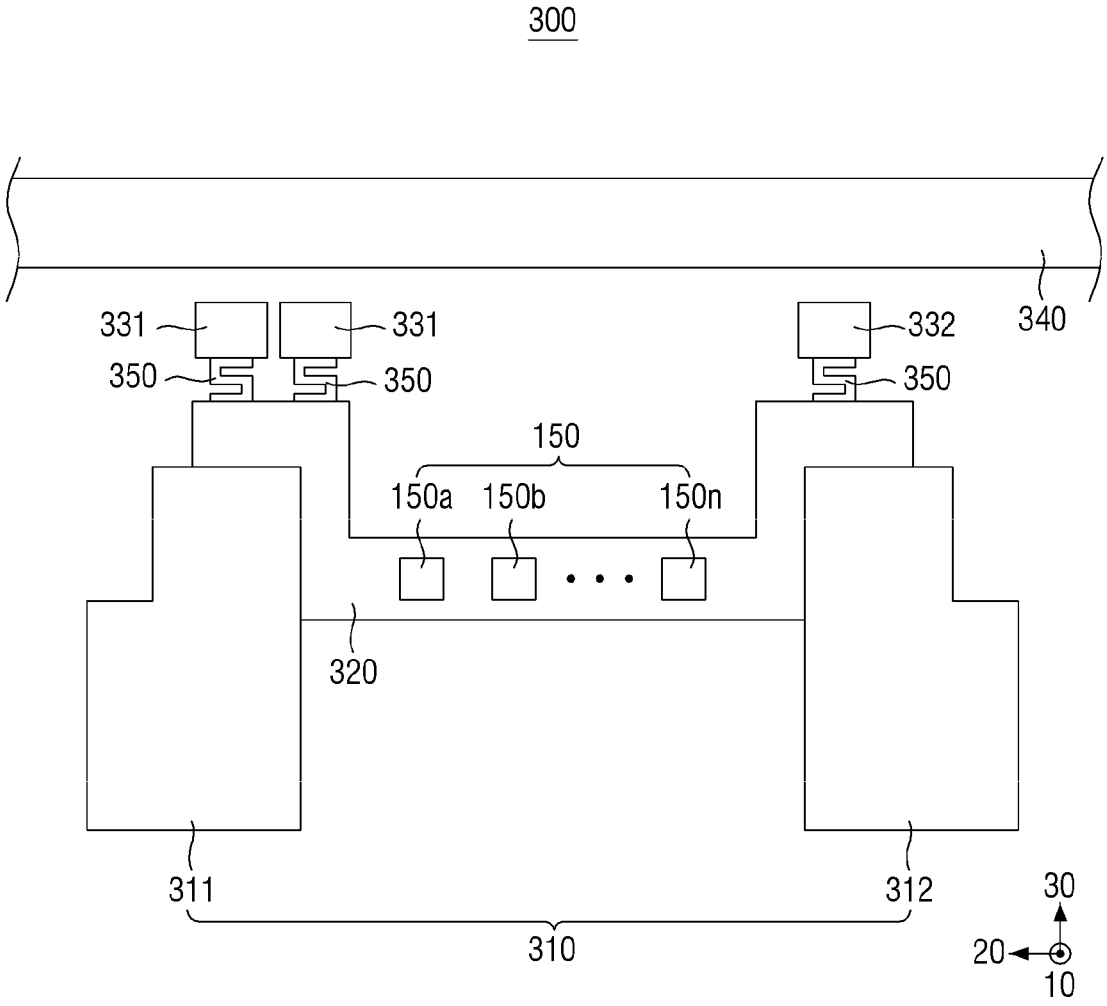

[FIG. 10]
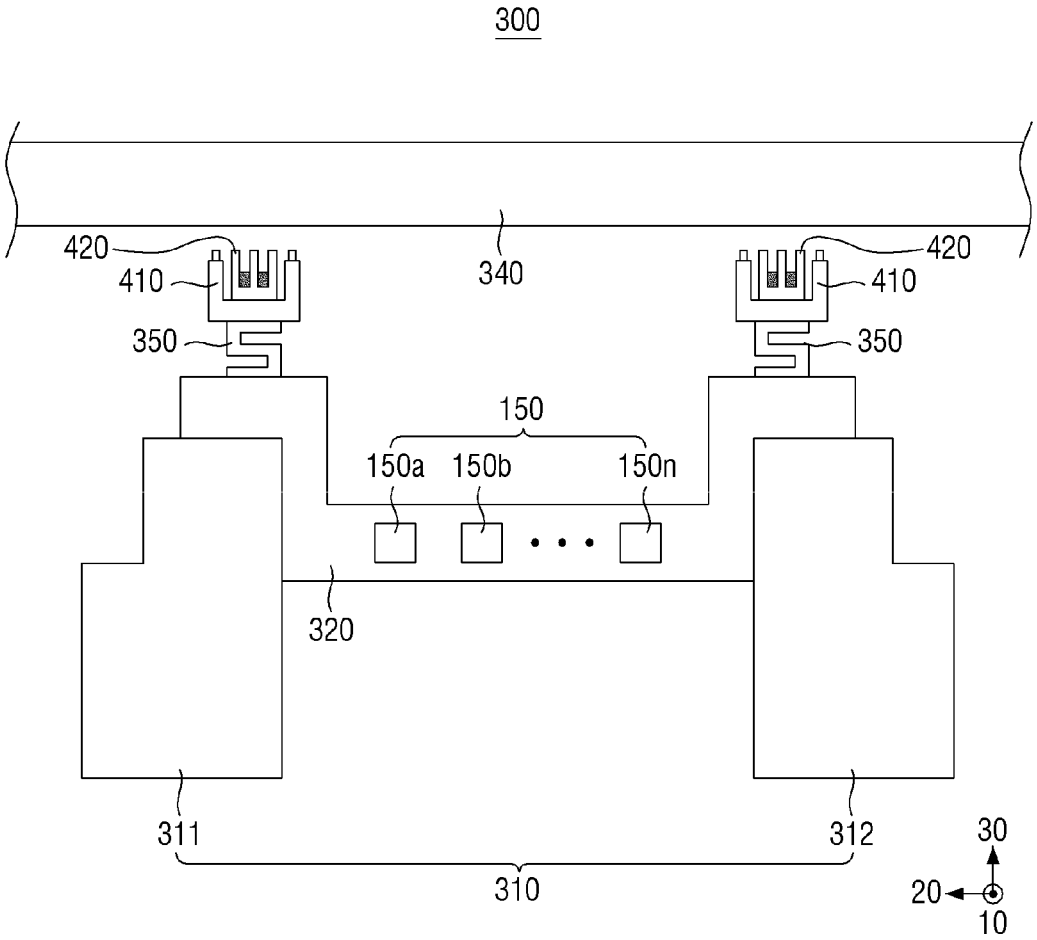

[FIG. 11]
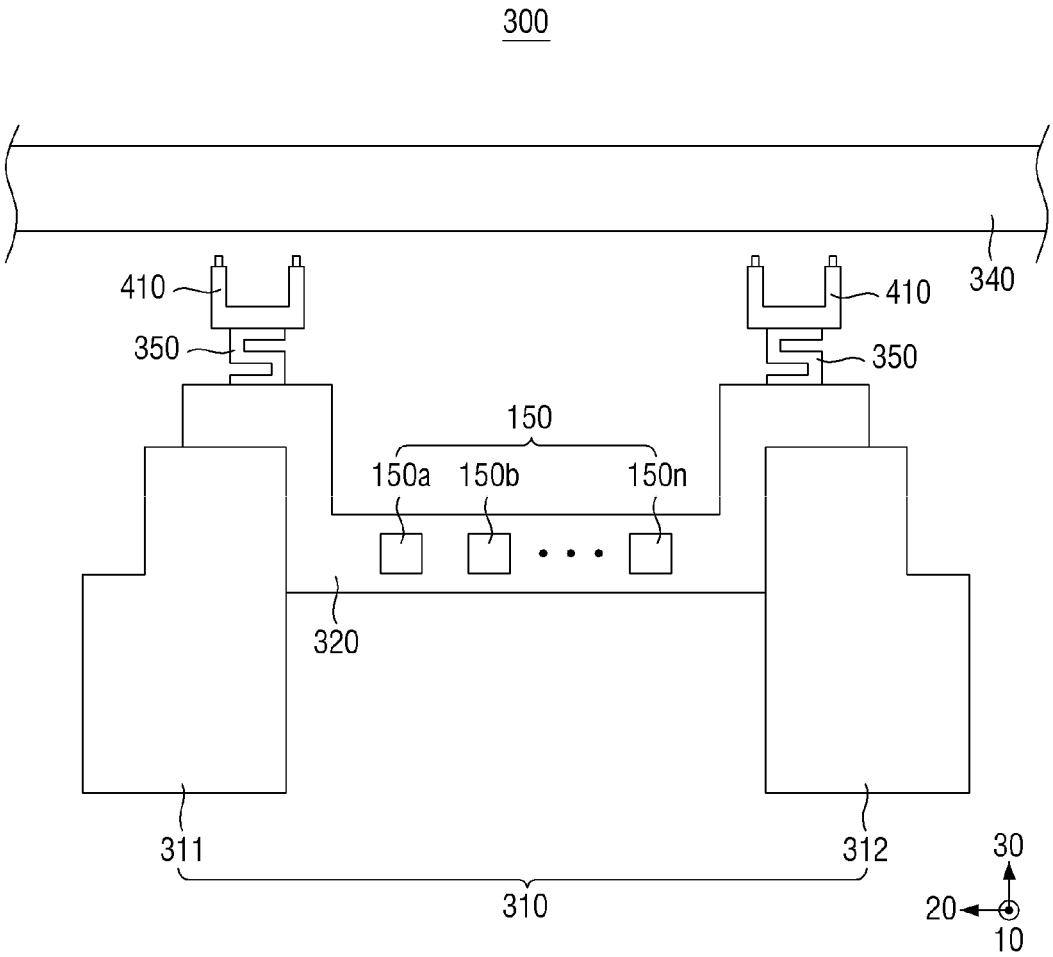

[FIG. 12]
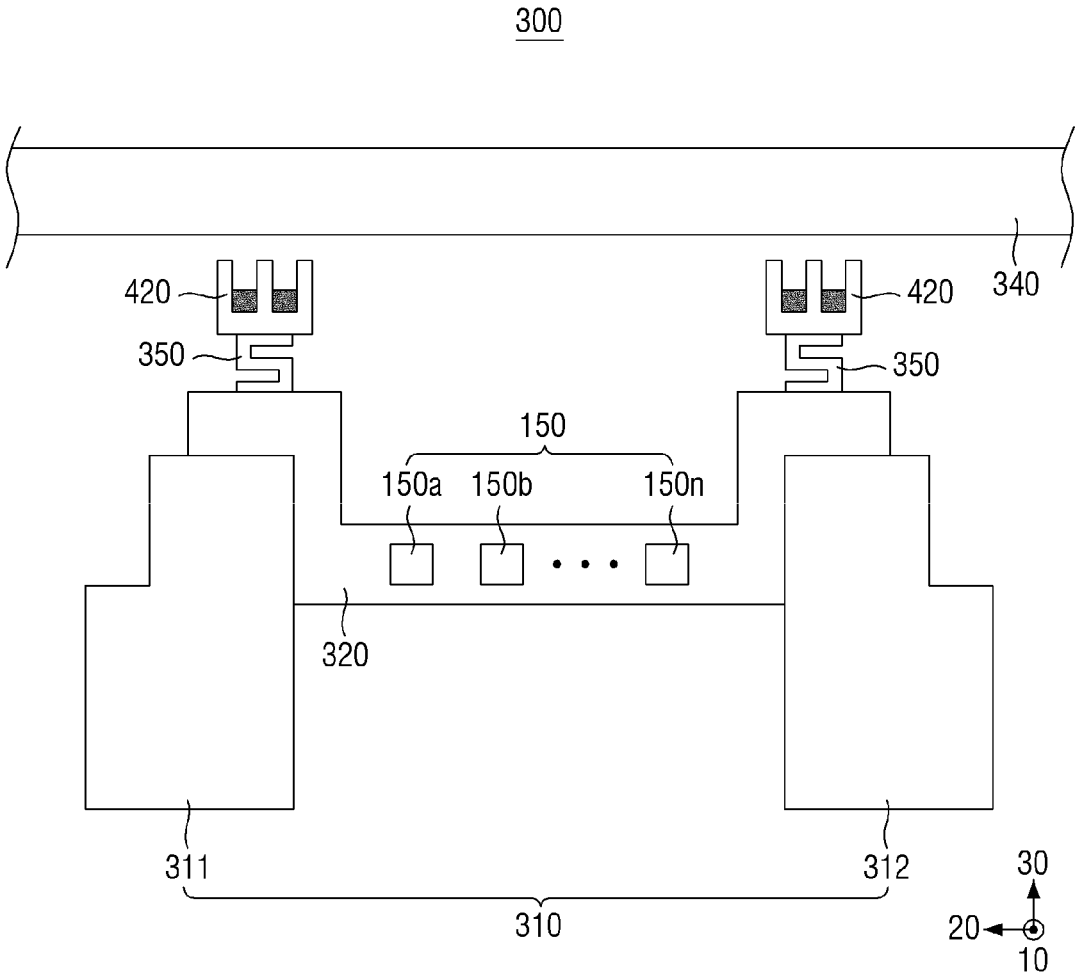

[FIG. 13]
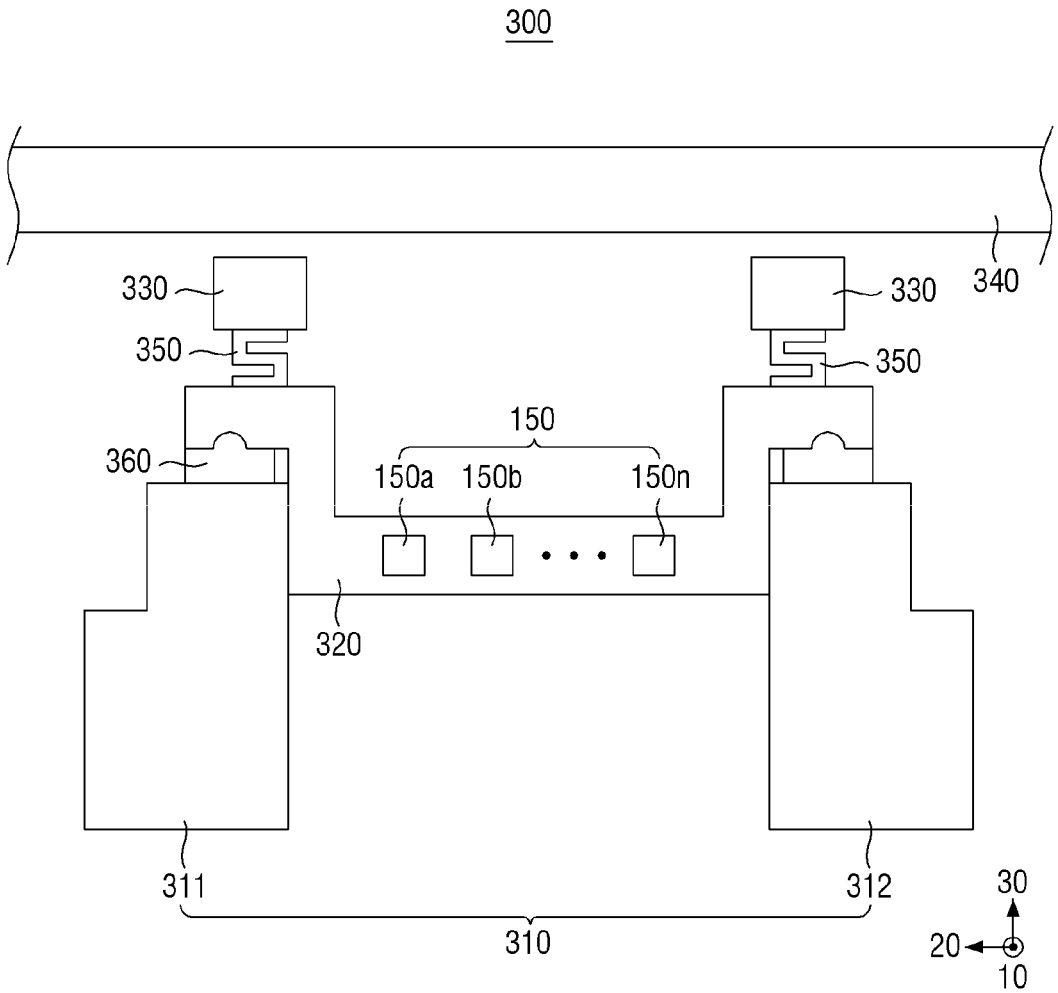

[FIG. 14]
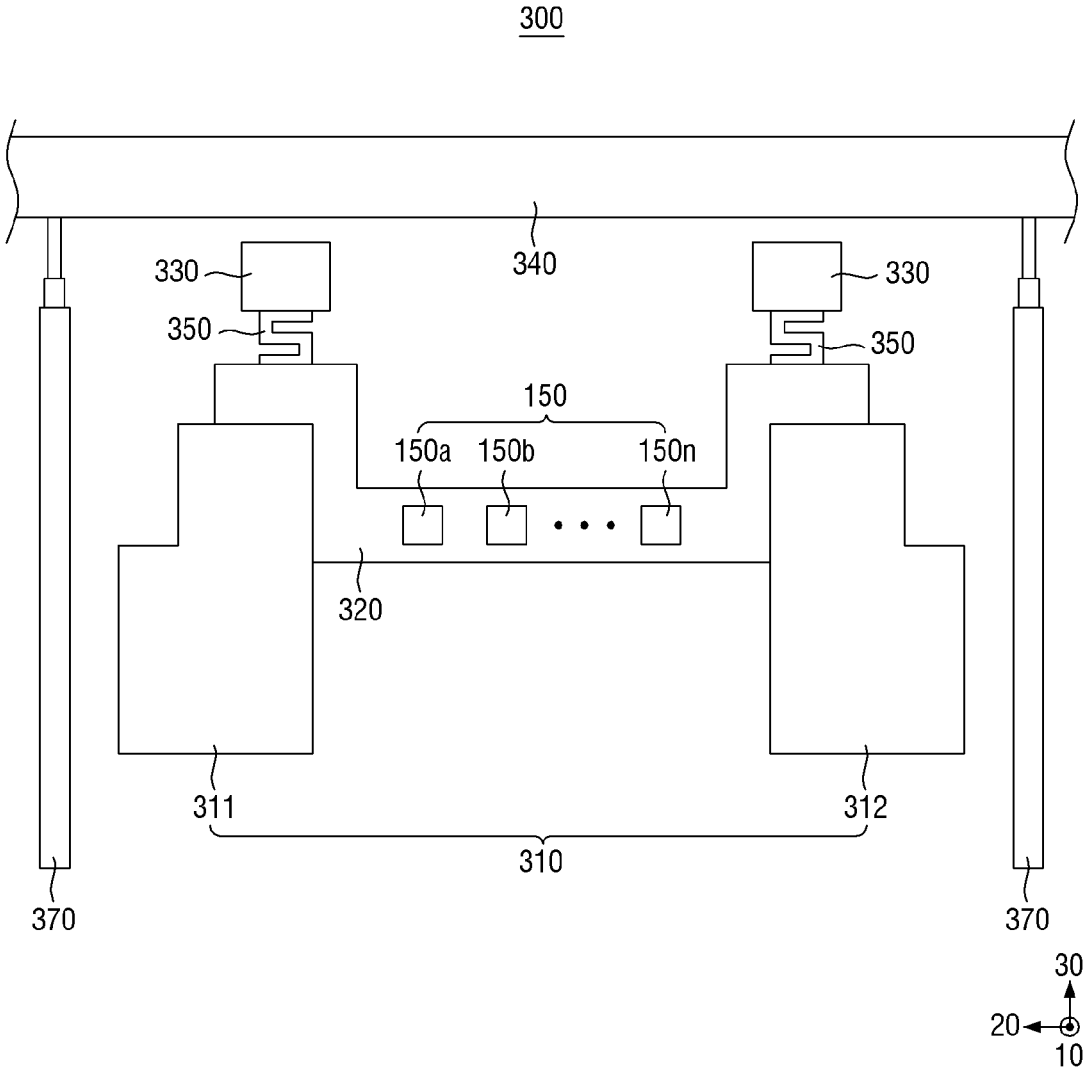

[FIG. 15]
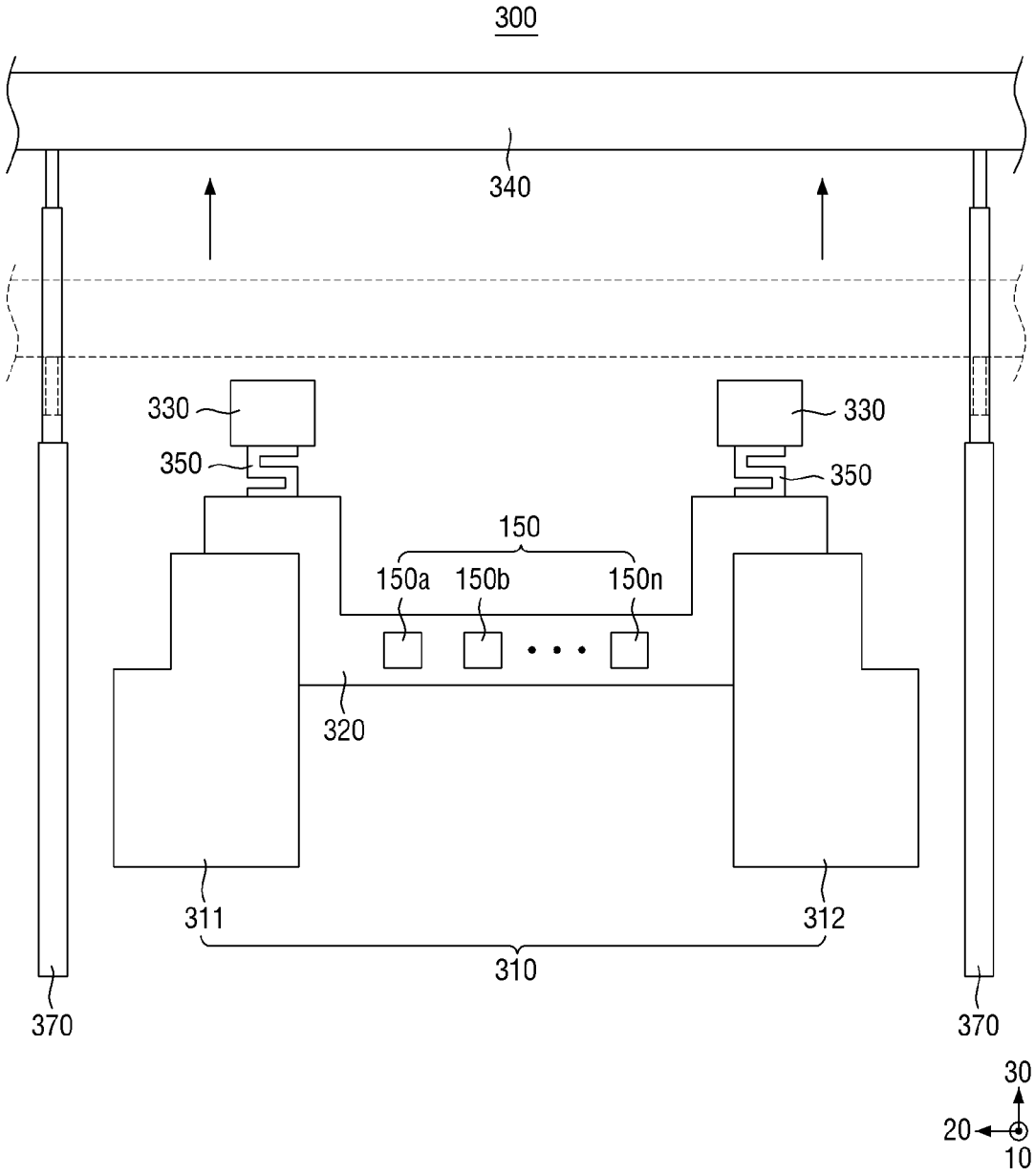

[FIG. 16]
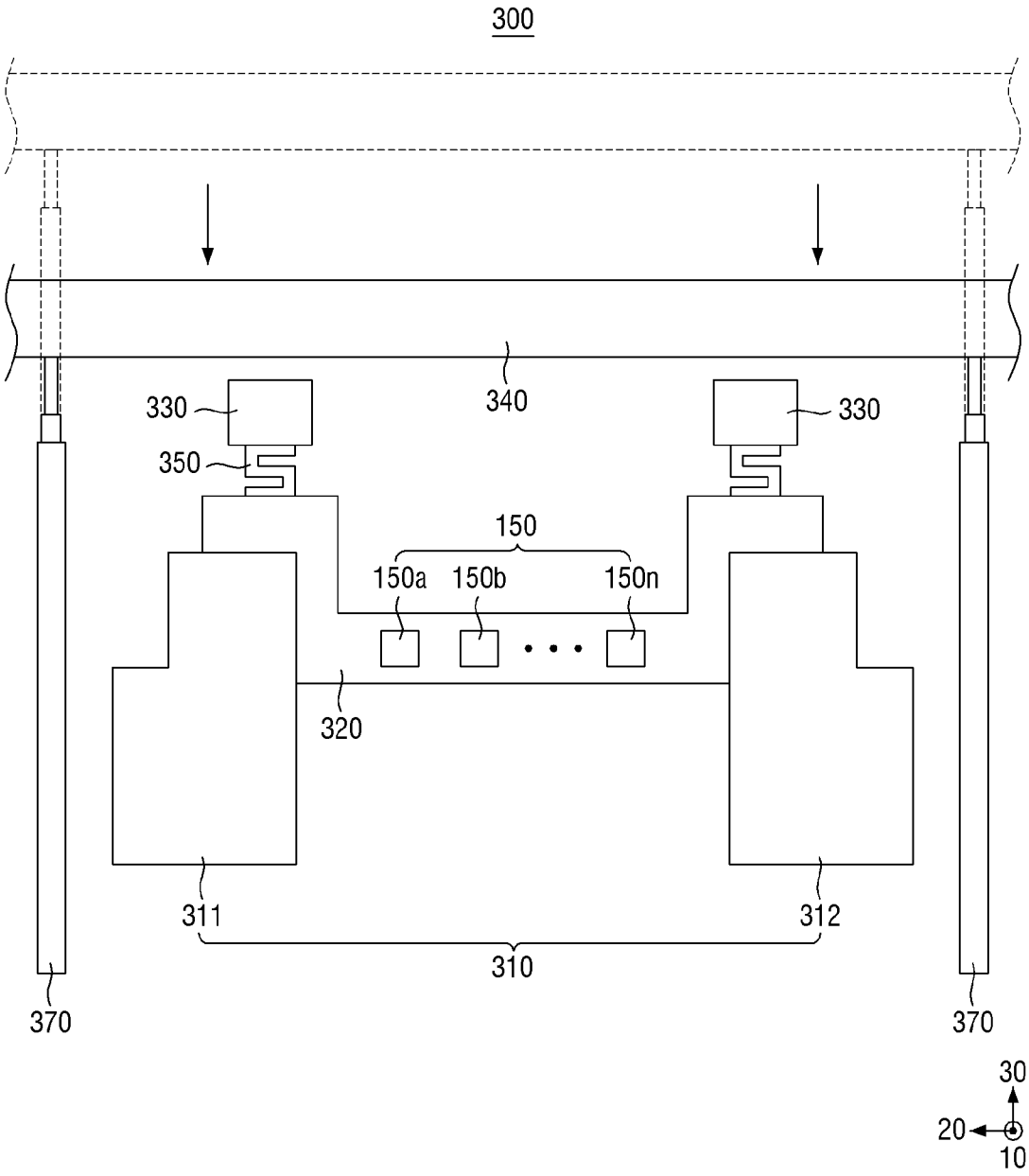

[FIG. 17]
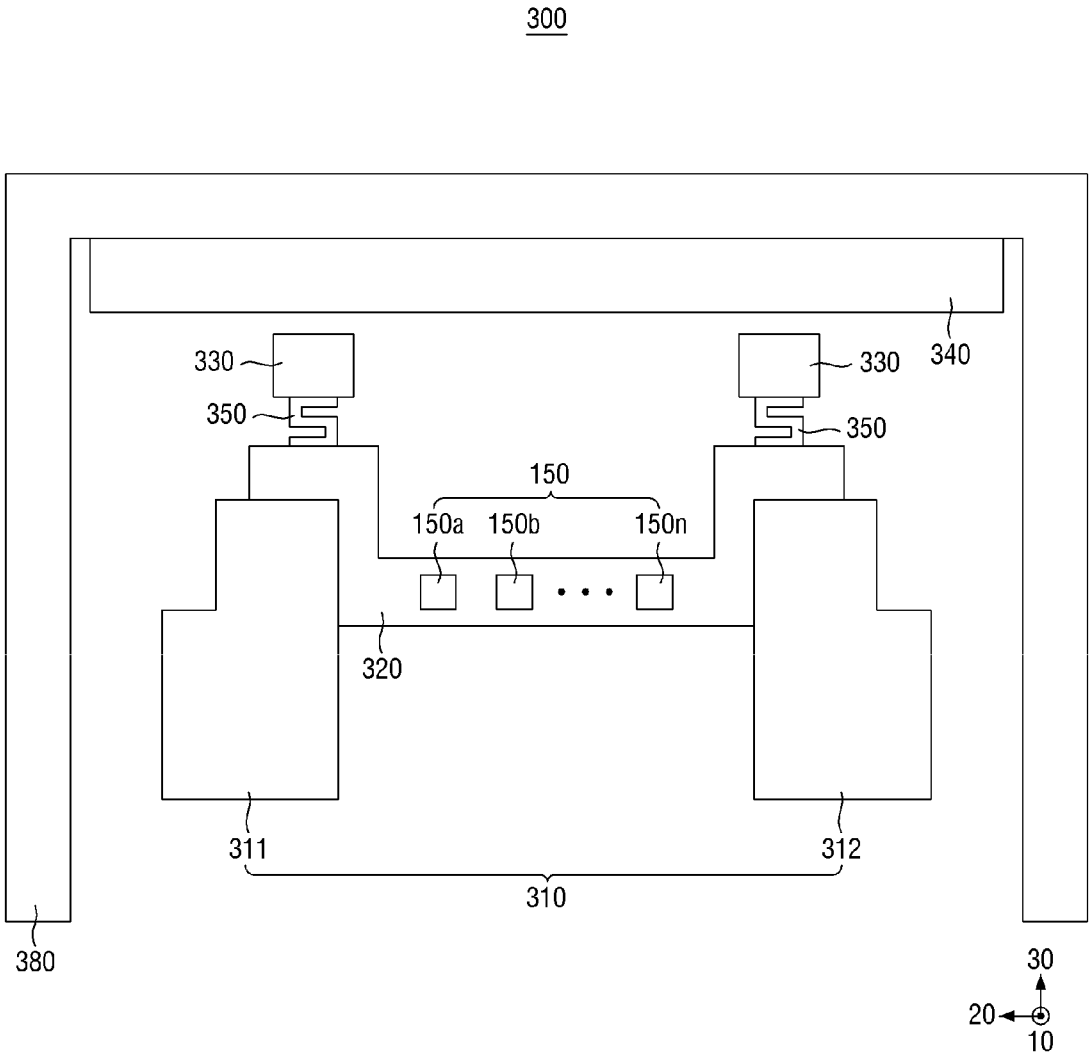

[FIG. 18]
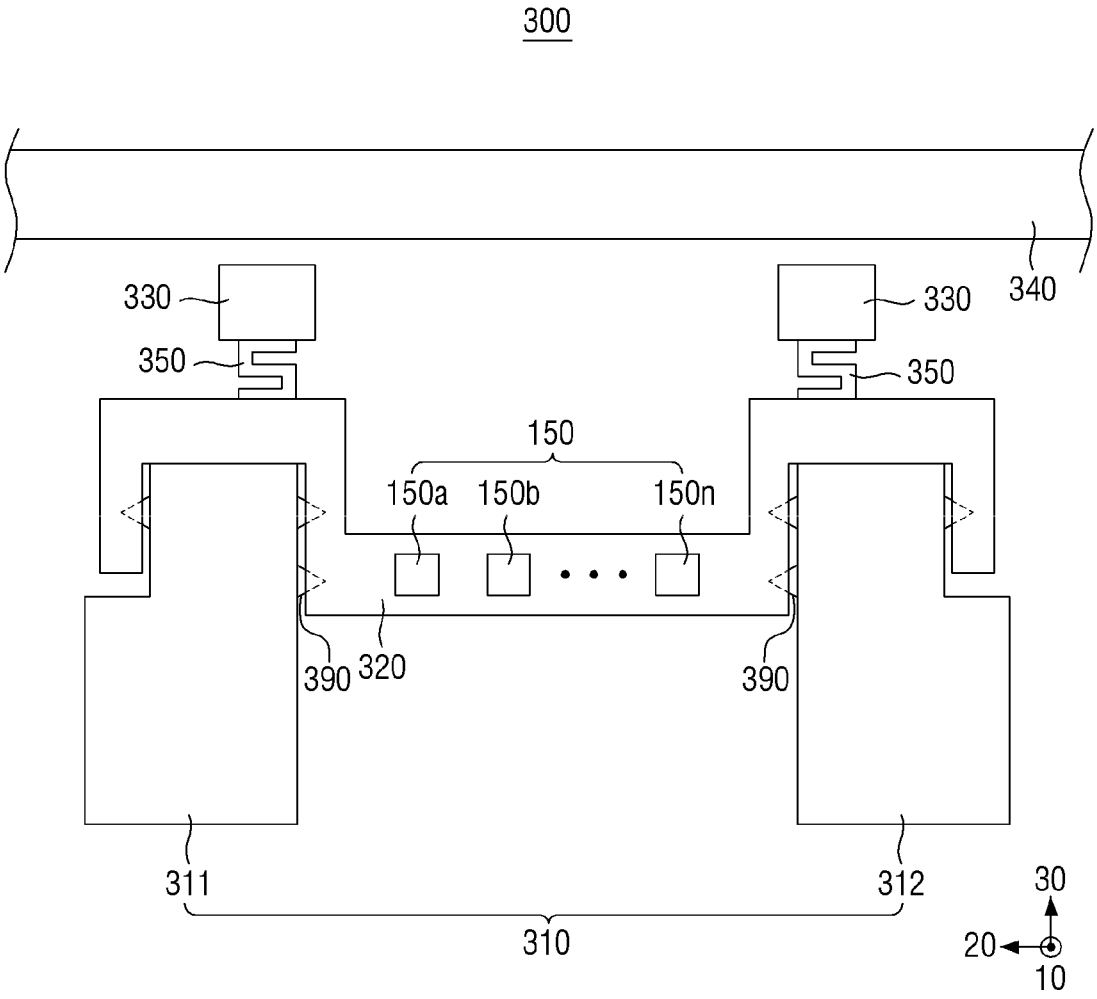

[FIG. 19]
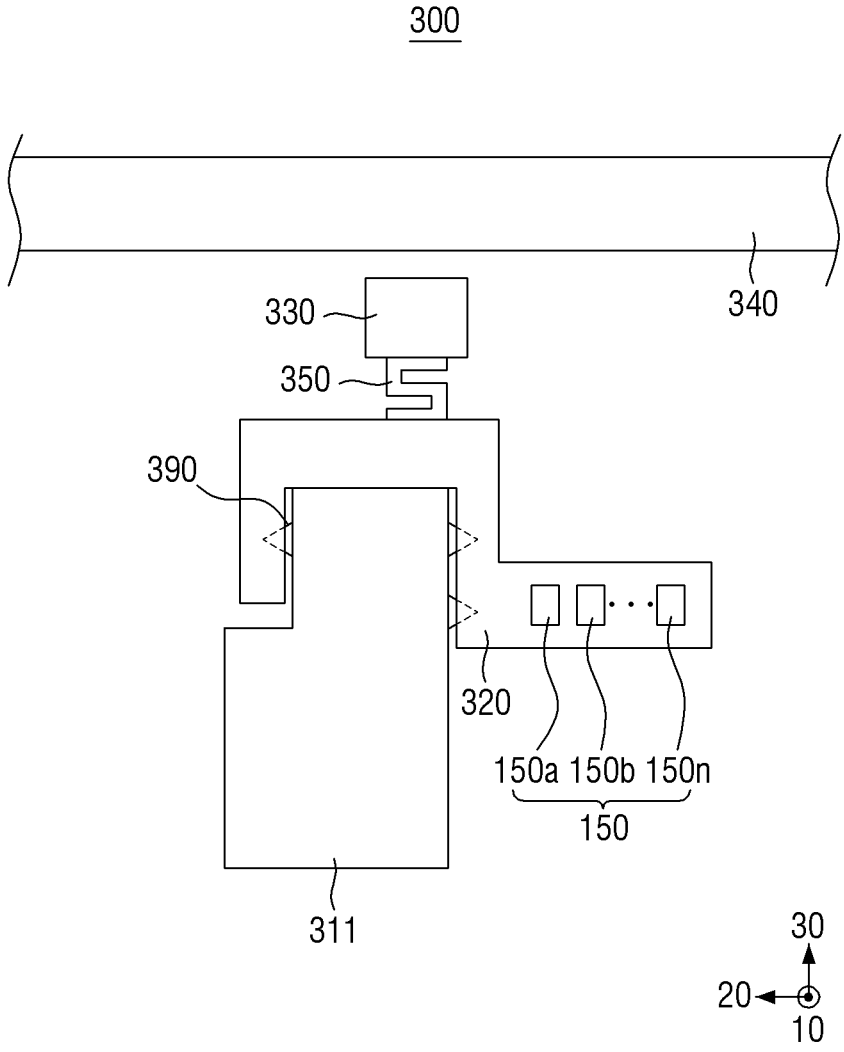

APPARATUS FOR DISTRIBUTING LOAD AND SYSTEM FOR TREATING SUBSTRATE WITH THE APPARATUS

CROSS-REFERENCE TO RELATED APPLICATIONS

This application claims priority from Korean Patent Application No. 10-2020-0049568 Filed on Apr. 23, 2020, in the Korean Intellectual Property Office, the disclosure of which is incorporated herein by reference in its entirety.

FIELD OF THE DISCLOSURE

The present disclosure relates to a load distribution apparatus and a substrate treatment system including the same. More specifically, the present disclosure relates to a load distribution apparatus for a plurality of inkjet head modules and a substrate treatment system including the same.

DESCRIPTION OF THE RELATED ART

When a printing process is performed on a transparent substrate in order to manufacture a display device such as a liquid crystal display (LCD) device, printing equipment including an inkjet head module may be used.

SUMMARY OF THE INVENTION

An inkjet head module discharges ink or the like onto a substrate. The inkjet head module may be supported by a gantry unit and disposed on a substrate to perform such a function. A plurality of inkjet head modules may be installed in the gantry unit in order to discharge ink or the like onto a substrate of various sizes (e.g., a large-area substrate).

However, when the plurality of inkjet head modules are installed in the gantry unit, an occurrence of distortion (e.g., a yaw) in each shaft of the gantry unit may increase due to a weight of the inkjet head module, and mechanical deformation due to thermal deformation may increase.

Aspects of the present disclosure provide a load distribution apparatus capable of efficiently distributing loads for the plurality of inkjet head modules, and a substrate treatment system including the same.

It should be noted that objects of the present disclosure are not limited to the above-described objects, and other objects of the present disclosure will be apparent to those skilled in the art from the following descriptions.

A load distribution apparatus according to an aspect of the present disclosure includes a second support formed to be elongated in one direction and having both side portions higher than a central portion and in which a head module discharging droplets onto a substrate is installed in the central portion, a first support configured to support the second support on at least one side and support the second support below the second support, a first support unit configured to support the second support on at least one side and support the second support above the second support, and a plate installed above the first support unit and connected to the first support unit, wherein a load of the head module is distributed by the first support and the first support unit.

The first support unit may support the second support in a non-contact manner.

The first support unit may support the second support using a magnet member, and the plate may be formed of a metal component as a material.

The magnet member may include at least one of a permanent magnet and an electromagnet.

When the magnet member includes both the permanent magnet and the electromagnet, the permanent magnet may be disposed on both sides of the electromagnet.

When the permanent magnet is disposed on the both sides of the electromagnet, the permanent magnet disposed on one side of the electromagnet may have a different polarity from the permanent magnet disposed on the other side of the electromagnet.

The magnet member may include a plurality of magnets.

At least one the first support unit may be installed on each side.

The first support units may be installed on at least both sides, and the number of the first support units installed on each side may be the same.

The first support unit may move the second support according to a direction in which a magnetic field is formed.

The load distribution apparatus may further include a second support unit installed on the first support and configured to support the second support in a non-contact manner.

The second support unit may be an air bearing.

The loads of the head module of different amounts may be distributed to the first support unit and the second support unit.

The load distribution apparatus may further include a height control member configured to adjust a height of the plate.

The second support may be installed to be movable on the first support.

The head module may be installed on a side surface or bottom of the second support and may be installed to be movable in a lateral direction.

The first support unit and the second support unit may support the second support using members of different types.

In addition, a load distribution apparatus according to another aspect of the present disclosure includes a second support formed to be elongated in one direction and having both side portions higher than a central portion and in which a head module discharging droplets onto a substrate is installed in the central portion, a first support configured to support the second support on at least one side and support the second support below the second support, a first support unit configured to support the second support on at least one side and support the second support above the second support, a plate installed above the first support unit and connected to the first support unit, and a second support unit installed on the first support and configured to support the second support in a non-contact manner, wherein a load of the head module is distributed by the first support and the first support unit, and the first support unit and the second support unit support the second support using members of different types.

In addition, a substrate treatment system according to an aspect of the present disclosure includes a base, a substrate support unit installed on the base and configured to support a substrate, and a load distribution apparatus installed on the base and including a head module discharging droplets onto the substrate, wherein the load distribution apparatus includes a second support formed to be elongated in one direction and having both side portions higher than a central portion and in which the head module discharging droplets onto the substrate is installed in the central portion, a first support configured to support the second support on at least one side and support the second support below the second support, a first support unit configured to support the second support on at least one side and support the second support above the second support, and a plate installed above the first support unit and connected to the first support unit, and a load of the head module is distributed by the first support and the first support unit.

The substrate treatment system may be printing equipment.

Specific details of other exemplary embodiments are included in the specific description and the drawings.

BRIEF DESCRIPTION OF THE DRAWINGS

The above and other aspects and features of the present disclosure will become more apparent by describing exemplary embodiments thereof in detail with reference to the attached drawings, in which:

FIG. 1 is a perspective view schematically illustrating an internal structure of a general substrate treatment system;

FIG. 2 is a plan view schematically illustrating the internal structure of the general substrate treatment system;

FIG. 3 is a cross-sectional view schematically illustrating a structure of a load distribution apparatus according to a first exemplary embodiment of the present disclosure;

FIG. 4 is a cross-sectional view schematically illustrating a structure of a load distribution apparatus according to a second exemplary embodiment of the present disclosure;

FIG. 5 is a cross-sectional view schematically illustrating a structure of a load distribution apparatus according to a third exemplary embodiment of the present disclosure;

FIG. 6 is a cross-sectional view schematically illustrating a structure of a load distribution apparatus according to a fourth exemplary embodiment of the present disclosure;

FIG. 7 is a cross-sectional view schematically illustrating a structure of a load distribution apparatus according to a fifth exemplary embodiment of the present disclosure;

FIG. 8 is a cross-sectional view schematically illustrating a structure of a load distribution apparatus according to a sixth exemplary embodiment of the present disclosure;

FIG. 9 is a cross-sectional view schematically illustrating a structure of a load distribution apparatus according to a seventh exemplary embodiment of the present disclosure;

FIG. 10 is a cross-sectional view schematically illustrating a structure of a load distribution apparatus according to an eighth exemplary embodiment of the present disclosure;

FIG. 11 is a cross-sectional view schematically illustrating a structure of a load distribution apparatus according to a ninth exemplary embodiment of the present disclosure;

FIG. 12 is a cross-sectional view schematically illustrating a structure of a load distribution apparatus according to a tenth exemplary embodiment of the present disclosure;

FIG. 13 is a cross-sectional view schematically illustrating a structure of a load distribution apparatus according to an eleventh exemplary embodiment of the present disclosure;

FIG. 14 is a cross-sectional view schematically illustrating a structure of a load distribution apparatus according to a twelfth exemplary embodiment of the present disclosure;

FIG. 15 is a cross-sectional view schematically illustrating a structure of a load distribution apparatus according to a thirteenth exemplary embodiment of the present disclosure;

FIG. 16 is a cross-sectional view schematically illustrating a structure of a load distribution apparatus according to a fourteenth exemplary embodiment of the present disclosure;

FIG. 17 is a cross-sectional view schematically illustrating a structure of a load distribution apparatus according to a fifteenth exemplary embodiment of the present disclosure;

FIG. 18 is a cross-sectional view schematically illustrating a structure of a load distribution apparatus according to a sixteenth exemplary embodiment of the present disclosure; and FIG. 19 is a cross-sectional view schematically illustrating a structure of a load distribution apparatus according to a seventeenth exemplary embodiment of the present disclosure.

DETAILED DESCRIPTION OF THE EXEMPLARY EMBODIMENTS

Hereinafter, exemplary embodiments of the present disclosure will be described in detail with reference to the accompanying drawings. Advantages and features of the present disclosure and methods for achieving them will be apparent with reference to the exemplary embodiments described below in detail with reference to the accompanying drawings. However, the present disclosure is not limited to the exemplary embodiments disclosed below but may be implemented in different forms, and only these exemplary embodiments are provided to complete the disclosure of the present disclosure, and to fully inform the scope of the invention to those of ordinary skill in the art to which the present disclosure pertains, that is, the present disclosure is defined only by the scope of the claims. The same reference numerals refer to the same elements throughout the specification.

When an element or layer is referred to as "on" another element or layer, this includes not only directly on another element or layer but also having another layer or element interposed therebetween. On the other hand, when an element is referred to as "directly on", this indicates that another element or layer is interposed therebetween.

Spatially relative terms such as "below", "beneath", "lower", "above", "upper", etc. can be used to easily describe the correlation between an element or components and another element or components. The spatially relative terms should be understood as terms including different directions of the element when in use or operating in addition to directions shown in the drawings. For example, when an element shown in the drawing is turned over, an element described as "below" or "beneath" another element may be placed "above" another element. Therefore, the exemplary term "below" may include both directions below and above. The element may be oriented in another direction, and thus the spatially relative terms may be interpreted according to the orientation.

Although the terms "first", "second", etc. are used to describe various elements, components, and/or sections, it should be understood that these elements, components and/or sections are not limited by these terms. These terms are only used to distinguish one element, component or section from another element, component or section. Therefore, it goes without saying that a first element, a first component, or a first section mentioned below may be a second element, a second component, or a second section within the technical scope of the present disclosure.

The terms used in the present specification are for describing exemplary embodiments and are not intended to limit the present disclosure. In this specification, the singular form also includes the plural form unless specifically stated in the phrase. As used in the specification, "comprises" and/or "comprising" does not preclude elements, steps, actions and/or elements mentioned and the presence or addition of one or more another component, steps, actions and/or elements.

When there is no other definition, all terms used in the specification (including technical and scientific terms) may be used with the same meaning that is commonly understood by one of ordinary skill in the art to which this disclosure belongs. In addition, the terms, such as those defined in commonly used dictionaries, are not to be ideally or over-interpreted unless expressly otherwise defined.

Hereinafter, the exemplary embodiments of the present disclosure will be described in detail with reference to the accompanying drawings. In the following description with the accompanying drawings, the same or corresponding components are designated by the same reference numerals regardless of drawing numbers, and duplicate description thereof will be omitted.

The present disclosure relates to a load distribution apparatus capable of distributing loads for a plurality of inkjet head modules, and a substrate treatment system including the same. The load distribution apparatus according to the present disclosure may reduce a support weight applied to a driving shaft by distributing loads for the plurality of inkjet head modules and may minimize a temperature change to reduce mechanical deformation.

Hereinafter, the present disclosure will be described in detail with reference to the drawings.

FIG. 1 is a perspective view schematically illustrating an internal structure of a general substrate treatment system. In addition, FIG. 2 is a plan view schematically illustrating the internal structure of the general substrate treatment system.

The substrate treatment system is for treating a substrate. Such a substrate treatment system may be implemented as printing equipment that discharges ink or the like onto the substrate using, for example, an inkjet head module.

Hereinafter, a case in which the substrate treatment system is the printing equipment will be described as an example.

Referring to FIGS. 1 and 2, printing equipment 100 may include a base 110, a substrate support unit 120, a gantry unit 130, a gantry moving unit 140, an inkjet head module 150, a head moving unit 160, a droplet discharge amount measuring unit 170, and a nozzle inspection unit 180.

The base 110 constitutes a body of the printing equipment 100. The base 110 may be provided in a rectangular parallelepiped shape having a predetermined thickness. Meanwhile, the substrate support unit 120 may be disposed on an upper surface of the base 110.

The substrate support unit 120 supports a substrate S. The substrate support unit 120 may include a support plate 121 on which the substrate S is placed.

The support plate 121 is one on which the substrate S is seated. The support plate 121 may be a flat plate having a quadrangular shape. Meanwhile, a rotation driving member 122 may be connected to a lower surface of the support plate 121.

The rotation driving member 122 rotates the support plate 121. To this end, the rotation driving member 122 may be implemented as a rotation motor. The rotation driving member 122 may rotate the support plate 121 using a rotation center shaft formed in a direction perpendicular to the support plate 121.

When the support plate 121 is rotated by the rotation driving member 122, the substrate S may also rotate along the support plate 121. For example, when a long side direction of a cell formed on the substrate S to which the droplet is to be applied is toward a second direction 20, the rotation driving member 122 may rotate the substrate so that the long side direction of the cell faces a first direction 10.

A linear driving member 123 linearly moves the support plate 121 and the rotation driving member 122. The linear driving member 123 may linearly move the support plate 121 and the rotation driving member 122 in the first direction 10.

The linear driving member 123 may include a slider 124 and a guide member 125. In this case, the rotation driving member 122 may be installed on an upper surface of the slider 124.

The guide member 125 may extend from a center portion of the upper surface of the base 110 in the first direction 10 as a longitudinal direction. A linear motor (not shown) may be built in the slider 124, and the slider 124 may be linearly moved in the first direction 10 along the guide member 125 by the linear motor.

The gantry unit 130 supports a plurality of inkjet head modules 150. The gantry unit 130 may be provided above a path through which the support plate 121 is moved.

The gantry unit 130 may be spaced apart from the upper surface of the base 110 in an upward direction. In addition, the gantry unit 130 may be disposed such that a longitudinal direction thereof faces the second direction 20.

The gantry moving unit 140 linearly moves the gantry unit 130 in the first direction 10. The gantry moving unit 140 may include a first moving unit 141 and a second moving unit 142.

The first moving unit 141 may be provided at one end of the gantry unit 130, and the second moving unit 142 may be provided at the other end of the gantry unit 130. In this case, the first moving unit 141 may slidingly move along a first guide rail 211 provided on one side of the base 110, and the second moving unit 142 may slidingly move along a second guide rail 212 provided on the other side of the base 110 to linearly move the gantry unit 130 in the first direction 10.

The inkjet head module 150 discharges droplets such as ink onto the substrate S. The inkjet head module 150 may be installed on a side surface of the gantry unit 130 and supported by the gantry unit 130.

The inkjet head module 150 may linearly move in the longitudinal direction of the gantry unit 130, that is, in the second direction 20 due to the head moving unit 160, and may also linearly move in a third direction 30. In addition, the inkjet head module 150 may also rotate about an axis parallel to the third direction 30 with respect to the head moving unit 160.

The plurality of inkjet head modules 150 may be provided on the gantry unit 130. Three inkjet head modules 150, for example, a first head unit 151, a second head unit 152, and a third head unit 153 may be provided. For example, the plurality of inkjet head modules 150 may be coupled to the gantry unit 130 in a line in the second direction 20.

The inkjet head module 150 may include a plurality of nozzles (not shown) discharging droplets and a nozzle plate (not shown) on which the plurality of nozzles are formed. For example, 128 nozzles or 256 nozzles may be provided in the inkjet head module 150.

The inkjet head module 150 may be provided with a number of piezoelectric elements corresponding to the plurality of nozzles. An amount of droplets discharged from the plurality of nozzles may be independently adjusted by controlling a voltage applied to the piezoelectric element.

The head moving unit 160 linearly moves the inkjet head module 150. The head moving unit 160 may be provided in the printing equipment 100 corresponding to the number of inkjet head modules 150. For example, when three inkjet head units 150 such as the first head unit 151, the second head unit 152, and the third head unit 153 are provided, three head moving units 160 may also be provided.

Meanwhile, one head moving unit 160 may be provided, and in this case, the inkjet head modules 150 may be moved together at the same time without moving individually.

The droplet discharge amount measuring unit 170 measures the droplet discharge amount of the inkjet head module 150. The droplet discharge amount measuring unit 170 may be disposed on one side of the substrate support unit 120 on the base 110.

The droplet discharge amount measuring unit 170 may measure an amount of droplets discharged from all nozzles for each inkjet head module 150. Whether all nozzles of the inkjet head module 150 are abnormal may be checked macroscopically through the measurement of the droplet discharge amount of the inkjet head module 150. That is, when the droplet discharge amount of the inkjet head module 150 deviates from a reference value, it can be seen that at least one of the inkjet head modules 150 has an abnormality.

The inkjet head module 150 may be moved in the first direction 10 and the second direction 20 by the gantry moving unit 140 and the head moving unit 160 to be positioned above the droplet discharge amount measuring unit 170. The head moving unit 160 may move the inkjet head module 150 in the third direction 30 to adjust a vertical distance between the inkjet head module 150 and the droplet discharge amount measuring unit 170.

The nozzle inspection unit 180 checks whether an individual nozzle provided in the inkjet head module 150 is abnormal. For example, the nozzle inspection unit 180 may check whether an individual nozzle is abnormal through optical inspection.

As a result of macroscopically checking whether the nozzle in the droplet discharge amount measuring unit 170 is abnormal, when it is determined that there is an abnormality in an unspecified nozzle, the nozzle inspection unit 180 may perform the total inspection of the nozzle while checking whether the individual nozzle is abnormal.

The nozzle inspection unit 180 may be disposed on one side of the substrate support unit 120 on the base 110. The inkjet head module 150 may be moved in the first direction 10 and the second direction 20 by the gantry moving unit 140 and the head moving unit 160 to be positioned above the nozzle inspection unit 180. The head moving unit 160 may move the inkjet head module 150 in the third direction 30 to adjust a vertical distance between the inkjet head module 150 and the nozzle inspection unit 180.

Meanwhile, the printing equipment 100 may further include a droplet supply device 190.

The droplet supply device 190 may be installed on upper and side portions of the gantry unit 130. The droplet supply device 190 may include a droplet supply module 191 and a pressure control module 192.

The droplet supply module 191 supplies a liquid such as ink to the inkjet head module 150. After receiving the liquid from a storage tank (not shown) storing the liquid, the droplet supply module 191 may supply the liquid to the inkjet head module 150.

The pressure control module 192 controls pressure of the droplet supply module 191. The pressure control module 192 may control the pressure of the droplet supply module 191 by providing positive pressure or negative pressure to the droplet supply module 191.

Meanwhile, the droplet supply module 191 and the pressure control module 192 may be coupled to the gantry unit 130.

The gantry unit 130 may support the plurality of inkjet head modules 150. However, in this case, a distortion phenomenon may occur in each shaft of the gantry unit 130 due to a weight of the inkjet head module 150, and accordingly, a yaw may occur. In addition, a temperature increases due to an increase in load of a motor during operation of the equipment, and thus mechanical deformation due to thermal deformation may increase.

As described above, the gantry unit 130 needs to provide a method of reducing the weight and a method of minimizing a temperature change to support the plurality of inkjet head modules 150. However, there is difficulty in dealing with mechanical deformation in applying the above method to a conventional gantry unit.

Accordingly, in the exemplary embodiment, a load distribution apparatus capable of efficiently distributing loads for a plurality of inkjet head modules instead of the conventional gantry unit is proposed. Hereinafter, this will be described.

FIG. 3 is a cross-sectional view schematically illustrating a structure of a load distribution apparatus according to a first exemplary embodiment of the present disclosure.

Referring to FIG. 3, a load distribution apparatus 300 may include a first support 310, a second support 320, a first support unit 330, and a plate 340.

The first support 310 supports the second support 320 on which the inkjet head module 150 is installed. The first support 310 may be provided with two first supports 311 and 312 to support the second support 320 from both sides.

However, this exemplary embodiment is not limited thereto. As shown in FIG. 4, the first support 310 may be provided with one first support 311 to support the second support 320 from one side. FIG. 4 is a cross-sectional view schematically illustrating a structure of a load distribution apparatus according to a second exemplary embodiment of the present disclosure.

Meanwhile, the first supports 310 may be provided with three or more to support the second support 320 from at least one side.

This will be described again with reference to FIG. 3.

The first support 310 may move along a guide rail installed on the base 110. For example, when the first support 310 is provided with two first support 311 and 312, one first support 311 may move along the first guide rail 211, the other first support 312 may move along the second guide rail 212.

The first support 310 may move in one direction on the base 110. For example, the first support 310 may move in the first direction 10 on the base 110. However, this exemplary embodiment is not limited thereto. The first support 310 may also move in a plurality of directions on the base 110. For example, the first support 310 may move in the first direction 10 and the second direction 20 on the base 110.

When the first support 310 moves in at least one of the first direction 10, the second direction 20, and the third direction 30, the first support 310 may move in a straight line on the base 110. However, this exemplary embodiment is not limited thereto. The first support 310 may move in a curve on the base 110 or may move diagonally on the base 110.

The second support 320 has the plurality of inkjet head modules 150 installed thereon. The second support 320 may be supported by the first support 310.

The second support 320 may be formed with the second direction 20 as a length direction. At this time, both side portions of the second support 320 may be formed higher in the third direction 30 than a center portion thereof, and the plurality of inkjet head modules 150 may be installed in the center portion of the second support 320.

The second support 320 may move on the base 110 so that the plurality of inkjet head modules 150 may discharge droplets to a designated position on the substrate S. The second support 320 may be moved on the base 110 by the first support 310.

However, this exemplary embodiment is not limited thereto. The second support 320 may move on the base 110 separately (i.e., independently) from the first support 310. In this case, the second support 320 may move on the first support 310 along a guide rail installed on the first support 310. The second support 320 may move, for example, on the first support 310 along a third guide rail 221 installed on one first support 311 and along a fourth guide rail 222 installed on the other first support 312, as shown in FIG. 5. FIG. 5 is a cross-sectional view schematically illustrating a structure of a load distribution apparatus according to a third exemplary embodiment of the present disclosure.

When the second support 320 moves along the guide rail installed on the first support 310, the second support 320 may move in one direction on the first support 310. For example, the second support 320 may move in the first direction 10 on the first support 310. However, this exemplary embodiment is not limited thereto. The second support 320 may move in a plurality of directions on the first support 310. For example, the second support 320 may move in the first direction 10 and the second direction 20 on the first support 310.

When the second support 320 moves in at least one of the first direction 10, the second direction 20, and the third direction 30, the second support 320 may move in a straight line on the first support 310. However, this exemplary embodiment is not limited thereto. The second support 320 may move in a curve on the first support 310 or may move diagonally on the first support 310.

Meanwhile, when the second support 320 moves along the guide rail installed on the first support 310, the first support 310 may be fixedly installed on the base 110.

This will be described again with reference to FIG. 3.

As described above, the inkjet head module 150 may be installed on the second support 320 in plural. For example, the inkjet head module 150 including n inkjet head modules such as a first inkjet head module 150*a*, a second inkjet head module 150*b*, . . . , and an n-th inkjet head module 150*n* (where n is a natural number of 2 or more) may be installed on the second support 320. However, this exemplary embodiment is not limited thereto. The inkjet head module 150 may be installed in a single unit on the second support 320.

The inkjet head module 150 may be installed on a side surface of the second support 320 to effectively discharge droplets onto the substrate S. However, this exemplary embodiment is not limited thereto. The inkjet head module 150 may be installed under the second support 320 as shown in FIG. 6. FIG. 6 is a cross-sectional view schematically illustrating a structure of a load distribution apparatus according to a fourth exemplary embodiment of the present disclosure.

The inkjet head module 150 may be fixedly installed on the second support 320. However, this exemplary embodiment is not limited thereto. The inkjet head module 150 may be installed to be movable on the second support 320.

When the inkjet head module 150 is installed on the side surface of the second support 320, as shown in FIG. 7, the inkjet head module 150 may be installed to be movable in a lateral direction (e.g., a positive (plus) second direction 20, a negative (minus) second direction 20, etc.). However, this exemplary embodiment is not limited thereto. The inkjet head module 150 may be installed to be movable in a vertical direction (e.g., a positive third direction 30, a negative third direction 30, etc.). FIG. 7 is a cross-sectional view schematically illustrating a structure of a load distribution apparatus according to a fifth exemplary embodiment of the present disclosure.

Meanwhile, when the inkjet head module 150 is installed under the second support 320, the inkjet head module 150 may be installed to be movable in the second direction 20 and may also be installed to be movable in the first direction 10.

This will be described again with reference to FIG. 3.

The first support unit 330 is for supporting the second support 320 on which the plurality of inkjet head modules 150 are installed. The first support unit 330 may support the second support 320 on at least one side along with the first support 310.

When the first support unit 330 and the first support 310 support the second support 320 together, the first support unit 330 and the first support 310 may support the second support 320 on the upper and lower portions with the second support 320 interposed therebetween, respectively. For example, the first support unit 330 may support the second support 320 above the second support 320, and the first support 310 may support the second support 320 below the second support 320.

The first support 310 may be provided with two first support 311 and 312 to support both sides of the second support 320 at the lower portion. Likewise, the first support unit 330 may also be provided with two support units to support both sides of the second support 320 at the upper portion. As such, when the first support unit 330 and the first support 310 each support the second support 320 at the upper and lower portions with the second support 320 interposed therebetween, the second support 320 may be stably supported, and it is possible to obtain an effect of distributing the load applied to the second support 320 due to the weight of the plurality of inkjet head modules 150.

When the first support unit 330 and the first support 310 support the second support 320 on the upper and lower portions with the second support 320 interposed therebetween, a plurality of first support units 330 may support the second support 320 above the second support 320. However, this exemplary embodiment is not limited thereto. In this exemplary embodiment, a single first support unit 330 may support the second support 320 above the second support 320.

As previously described, a plurality of first supports 310 may support the second support 320. In this case, the same number of first support units 330 may be disposed above the first supports 310 disposed on each side. However, this exemplary embodiment is not limited thereto. A different number of first support units 330 may also be disposed above the first supports 310 disposed on each side.

Assuming that one first support 311 and the other first support 312 are supporting the second support 320 at the lower portions of both sides, here, the first support unit 330 supporting the second support 320 above one first support 311 is defined as one first support unit 331, and the first support unit 330 supporting the second support 320 above the other first support 312 is defined as the other first support unit 332.

In this case, one first support unit 331 may be provided with the same number as the other first support unit 332. For example, as illustrated in FIG. 8, one first support unit 331 and the other first support unit 332 may be provided with two support units, respectively. FIG. 8 is a cross-sectional view schematically illustrating a structure of a load distribution apparatus according to a sixth exemplary embodiment of the present disclosure.

However, this exemplary embodiment is not limited thereto. One first support unit 331 may be provided with a different number from the other first support unit 332. For example, as shown in FIG. 9, one first support unit 331 may be provided with two support units, and the other first support unit 332 may be provided with one support unit. FIG. 9 is a cross-sectional view schematically illustrating a structure of a load distribution apparatus according to a seventh exemplary embodiment of the present disclosure.

In this case, one first support unit 331 may be provided in a larger number than the other first support unit 332 as shown in FIG. 9. However, this exemplary embodiment is not limited thereto. One first support unit 331 may be provided in a smaller number than the other first support unit 332.

The first support unit 330 may support the second support 320 in a non-contact manner. The first support unit 330 may be implemented as, for example, a magnet member, and may support the second support 320 using an attractive force acting between the first support unit 330 and the plate 340 disposed thereon.

When the first support unit 330 supports the second support 320 in a non-contact manner as described above, it is possible to reduce a support weight for a driving shaft so that it is possible to prevent occurrence of a distortion phenomenon (yaw) of each shaft due to the weight of the plurality of inkjet head modules 150, and mechanical deformation due to thermal deformation may also be prevented.

As described above, the first support unit 330 may be implemented as a magnet member. For example, the first support unit 330 may be implemented as a magnet member such as a permanent magnet, an electromagnet, and the like. However, this exemplary embodiment is not limited thereto. When the first support unit 330 has a structure capable of compensating for a load on the second support 320 in the non-contact manner, the first support unit 330 may be implemented by something other than the magnet member.

When the first support unit 330 is implemented as the magnet member, the first support unit 330 may be implemented as a combination of a permanent magnet 410 and an electromagnet 420 as shown in FIG. 10. FIG. 10 is a cross-sectional view schematically illustrating a structure of a load distribution apparatus according to an eighth exemplary embodiment of the present disclosure.

However, this exemplary embodiment is not limited thereto. The first support unit 330 may be implemented as only the permanent magnet 410 as shown in FIG. 11 or may be implemented as only the electromagnet 420 as shown in FIG. 12. FIG. 11 is a cross-sectional view schematically illustrating a structure of a load distribution apparatus according to a ninth exemplary embodiment of the present disclosure, and FIG. 12 is a cross-sectional view schematically illustrating a structure of a load distribution apparatus according to a tenth exemplary embodiment of the present disclosure.

When the first support unit 330 is implemented as the combination of the permanent magnet 410 and the electromagnet 420, the electromagnet 420 may be disposed in a center thereof, and the permanent magnet 410 may be disposed on both sides thereof. When the first support unit 330 is implemented as the combination of the permanent magnet 410 and the electromagnet 420, an arrangement structure of the permanent magnet 410 and the electromagnet 420 may be variously designed at the discretion of those skilled in the art.

Meanwhile, when the electromagnet 420 is disposed in the center thereof and the permanent magnet 410 is disposed on both sides thereof, the permanent magnet 410 disposed on one side of the electromagnet 420 and the permanent magnet 410 disposed on the other side of the electromagnet 420 may have different polarities. For example, the permanent magnet 410 disposed on one side of the electromagnet 420 may have a polarity of S-pole-N-pole in the third direction 30, and the permanent magnet 410 disposed on the other side of the electromagnet 420 may have a polarity of N-pole-S-pole in the third direction 30. However, this exemplary embodiment is not limited thereto. The permanent magnet 410 disposed on one side of the electromagnet 420 and the permanent magnet 410 disposed on the other side of the electromagnet 420 may have the same polarity.

The first support unit 330 may be implemented as a plurality of magnet members. In this case, the first support unit 330 may support the second support 320 in a non-contact manner using active magnetic bearings, that is, a tripod floater. The first support unit 330 may distribute the self-weight of the inkjet head module 150 to each magnet member therethrough, and accordingly, it is possible to obtain an effect that the inkjet head module 150 may freely operate. Meanwhile, the first support unit 330 may also be implemented as a single magnet member.

The first support unit 330 may serve to support the second support 320 by fixing the position thereof, but it is also possible to move the second support 320 to a predetermined position. The first support unit 330 may change a direction in which a magnetic field is formed according to Fleming's law to move the second support 320 to the predetermined position.

Meanwhile, the first support unit 330 may be fastened to the second support 320 using a steel structure 350. However, this exemplary embodiment is not limited thereto. The first support unit 330 may be fastened to the second support 320 using a combination of a bolt and a nut.

This will be described again with reference to FIG. 3.

The plate 340 supports the second support 320 through interaction with the first support unit 330. The plate 340 may be disposed above the first support unit 330 to support the second support 320 using an attractive force with the first support unit 330.

The plate 340 may be formed in a large area to freely operate the inkjet head module 150. The plate 340 may be formed to have the same area as the base 110 and may be formed to have an area larger than the base 110.

When the first support unit 330 is implemented as a magnet member, the plate 340 may be made using a metal component as a material for the attractive force with the first support unit 330. For example, the plate 340 may be made using a steel as a material.

Meanwhile, the first support 310 may also support the second support 320 in a non-contact manner like the first support unit 330. Hereinafter, this will be described.

FIG. 13 is a cross-sectional view schematically illustrating a structure of a load distribution apparatus according to an eleventh exemplary embodiment of the present disclosure. The following description refers to FIG. 13.

The second support unit 360 is installed on the first support 310 to support the second support 320 in a non-contact manner. The second support unit 360 may be implemented as an air bearing. However, this exemplary embodiment is not limited thereto. The second support unit 360 may be implemented by something other than the air bearing when the second support unit 360 may effectively support the second support 320 in the non-contact manner.

When the load distribution apparatus 300 is configured to include the first support unit 330 and the second support unit 360, the same amount of load may be distributed to the first support unit 330 and the second support unit 360. However, this exemplary embodiment is not limited thereto. It is also possible to distribute loads of different amounts to the first support unit 330 and the second support unit 360.

When the first support unit 330 is formed in an arrangement structure of the permanent magnet 410—the electromagnet 420—the permanent magnet 410, and loads of different amounts are distributed to the first support unit 330 and the second support unit 360, for example, the permanent magnet 410, the electromagnet 420, and the second support unit 360 may be loaded at 60%, 20% and 20%, respectively. In this case, nominal clearances of the permanent magnet 410, the electromagnet 420, and the second support unit 360 may be set to 1.5 mm, 1.0 mm, and 5 μm, respectively.

Meanwhile, the load distribution apparatus 300 may further include a height control member 370 adjusting a height of the plate 340. Hereinafter, this will be described.

FIG. 14 is a cross-sectional view schematically illustrating a structure of a load distribution apparatus according to a twelfth exemplary embodiment of the present disclosure. The following description refers to FIG. 14.

The height control member 370 adjusts the height of the plate 340. A plurality of height control members 370 may be installed in an outer direction of the first support 310.

As shown in FIG. 15, the height control member 370 may raise the height of the plate 340 in a direction away from an upper portion of the first support 310 (i.e., the positive third direction 30). As described above, when the height control member 370 raises the height of the plate 340, the attractive force acting between the first support unit 330 and the plate 340 may be weakened, and accordingly, the load of the inkjet head module 150 applied to the first support 310 may be weighted. FIG. 15 is a cross-sectional view schematically illustrating a structure of a load distribution apparatus according to a thirteenth exemplary embodiment of the present disclosure.

On the other hand, as shown in FIG. 16, the height control member 370 may lower the height of the plate 340 in a direction that approaches the upper portion of the first support 310 (i.e., the negative third direction 30). As described above, when the height control member 370 lowers the height of the plate 340, the attractive force acting between the first support unit 330 and the plate 340 may be strengthened, and accordingly, it is possible to reduce the load of the inkjet head module 150 applied to the first support 310. FIG. 16 is a cross-sectional view schematically illustrating a structure of a load distribution apparatus according to a fourteenth exemplary embodiment of the present disclosure.

As shown above, the height control member 370 may adjust the height of the plate 340 to increase or decrease the load of the inkjet head module 150 applied to the first support 310.

Meanwhile, when the load distribution apparatus 300 does not include the height control member 370, the plate 340 may be disposed on the first support unit 330 through a column member 380 as shown in FIG. 17. FIG. 17 is a cross-sectional view schematically illustrating a structure of a load distribution apparatus according to a fifteenth exemplary embodiment of the present disclosure.

In the above description, a case in which the load distribution apparatus 300 supports the second support 320 in a non-contact manner through the first support unit 330 and the second support unit 360 has been described. However, this exemplary embodiment is not limited thereto. The load distribution apparatus 300 may support the second support 320 in a contact manner as shown in FIGS. 18 and 19. When the load distribution apparatus 300 is configured to include first supports 311 and 312 of a dual type, as shown in FIG. 18, the second support 320 may be supported in the contact manner, and when the load distribution apparatus 300 is configured to include a first support 311 of a single type, the second support 320 may be supported in the contact manner as shown in FIG. 19.

When the load distribution apparatus 300 supports the second support 320 in the contact manner, the second support 320 may be fixed to the first support 310 using a plurality of fixing members 390. FIG. 18 is a cross-sectional view schematically illustrating a structure of a load distribution apparatus according to a sixteenth exemplary embodiment of the present disclosure, and FIG. 19 is a cross-sectional view schematically illustrating a structure of a load distribution apparatus according to a seventeenth exemplary embodiment of the present disclosure.

The load distribution apparatus 300 according to an exemplary embodiment of the present disclosure has been described above with reference to FIGS. 3 to 19. The load distribution apparatus 300 may suppress the distortion phenomenon and thermal deformation through the distribution of the loads of the plurality of inkjet head modules 150, and in particular, it is possible to minimize the distortion of the plurality of inkjet head modules 150 through load distribution in the non-contact manner, and it is possible to obtain an effect of reducing vibration.

Although the exemplary embodiments of the present disclosure have been described with reference to the accompanying drawings, it should be clear to those of ordinary skill in the art to which the present disclosure pertains that the present disclosure can be implemented in other specific forms without changing the technical spirit or essential features of the present disclosure. Therefore, it should be understood that the exemplary embodiments described above are illustrative and non-limiting in all respects.

What is claimed is:

1. A load distribution apparatus comprising:

a second support formed to be elongated in one direction and having both side portions higher than a central portion and in which a head module discharging droplets onto a substrate is installed in the central portion;

a first support configured to support the second support on at least one side and support the second support below the second support;

a first support unit configured to support the second support on at least one side and support the second support above the second support; and a plate installed above the first support unit and connected to the first support unit, wherein a load of the head module is distributed by the first support and the first support unit.

2. The load distribution apparatus of claim 1, wherein the first support unit supports the second support in a non-contact manner.

3. The load distribution apparatus of claim 2, wherein the first support unit supports the second support using a magnet member, and the plate is formed of a metal component as a material.

4. The load distribution apparatus of claim 3, wherein the magnet member includes at least one of a permanent magnet and an electromagnet.

5. The load distribution apparatus of claim 4, wherein when the magnet member includes both the permanent magnet and the electromagnet, the permanent magnet is disposed on both sides of the electromagnet.

6. The load distribution apparatus of claim 5, wherein when the permanent magnet is disposed on the both sides of the electromagnet, the permanent magnet disposed on one side of the electromagnet has a different polarity from the permanent magnet disposed on the other side of the electromagnet.

7. The load distribution apparatus of claim 4, wherein the magnet member includes a plurality of magnets.

8. The load distribution apparatus of claim 1, wherein at least one first support unit is installed on each side.

9. The load distribution apparatus of claim 1, wherein the first support units are installed on at least both sides, and the number of the first support units installed on each side is the same.

10. The load distribution apparatus of claim 1, wherein the first support unit moves the second support according to a direction in which a magnetic field is formed.

11. The load distribution apparatus of claim 1, further comprising a second support unit installed on the first support and configured to support the second support in a non-contact manner.

12. The load distribution apparatus of claim 11, wherein the second support unit is an air bearing.

13. The load distribution apparatus of claim 11, wherein the loads of the head module of different amounts are distributed to the first support unit and the second support unit.

14. The load distribution apparatus of claim 11, wherein the first support unit and the second support unit support the second support using members of different types.

15. The load distribution apparatus of claim 1, further comprising a height control member configured to adjust a height of the plate.

16. The load distribution apparatus of claim 1, wherein the second support is installed to be movable on the first support.

17. The load distribution apparatus of claim 1, wherein the head module is installed on a side surface or bottom of the second support and is installed to be movable in a lateral direction.

18. A load distribution apparatus comprising:

a second support formed to be elongated in one direction and having both side portions higher than a central portion and in which a head module discharging droplets onto a substrate is installed in the central portion;

a first support configured to support the second support on at least one side and support the second support below the second support;

a first support unit configured to support the second support on at least one side and support the second support above the second support;

a plate installed above the first support unit and connected to the first support unit; and a second support unit installed on the first support and configured to support the second support in a non-contact manner, wherein a load of the head module is distributed by the first support and the first support unit, and the first support unit and the second support unit support the second support using members of different types.

19. A substrate treatment system comprising:

a base;

a substrate support unit installed on the base and configured to support a substrate; and a load distribution apparatus installed on the base and including a head module discharging droplets onto the substrate, wherein the load distribution apparatus includes:

a second support formed to be elongated in one direction and having both side portions higher than a central portion and in which the head module discharging droplets onto the substrate is installed in the central portion;

a first support configured to support the second support on at least one side and support the second support below the second support;

a first support unit configured to support the second support on at least one side and support the second support above the second support; and a plate installed above the first support unit and connected to the first support unit, and a load of the head module is distributed by the first support and the first support unit.

20. The substrate treatment system of claim 19, wherein the substrate treatment system is printing equipment.

* * * * *